US005611102A

United States Patent [19]

Lesinsky et al.

[11] Patent Number: 5,611,102

[45] Date of Patent: Mar. 18, 1997

[54] METHOD AND APPARATUS FOR APPLYING VISCOUS MATERIALS TO CURVED SURFACES

[76] Inventors: Michael A. Lesinsky, 178 Alexander Dr., Bridgeport, Conn. 06606; Kenneth A. Lesinsky, Jr., 26 Wildwood Ave., Milford, Conn. 06460; Jonathan V. Lesinsky, deceased, late of Milford, Conn.; by Kenneth A. Lesinsky, Sr., executor, 40 Boylston St., Milford, Conn. 06460

[21] Appl. No.: 515,127

[22] Filed: Aug. 15, 1995

[51] Int. Cl.[6] ..... B05C 17/10

[52] U.S. Cl. ..... 15/235.5; 15/235.8; 15/236.07; 15/245.1; 15/144.1; 425/458

[58] Field of Search ..... 15/235.5, 235.8, 15/236.07, 245.1, 144.1; 16/111 R; 425/458; D8/10

[56] References Cited

U.S. PATENT DOCUMENTS

| | | | |
|---|---|---|---|
| D. 200,244 | 2/1965 | Yates | D8/10 |
| 258,260 | 5/1882 | Staples | D8/10 |
| 952,971 | 3/1910 | Wolary et al. | 15/235.8 |
| 1,067,301 | 7/1913 | Bricker | 15/235.8 |
| 1,078,122 | 11/1913 | Bean | 15/235.5 |
| 1,083,099 | 12/1913 | Howg | 15/235.8 |
| 1,743,704 | 1/1930 | Boux | 15/235.8 |
| 2,947,017 | 8/1960 | Dybdahl | 15/235.8 |
| 3,123,947 | 3/1964 | Rawley | 15/235.8 |
| 3,341,878 | 9/1967 | Hubbard | 425/458 |
| 4,097,951 | 7/1978 | Hurtt | 15/245.1 |
| 4,631,019 | 12/1986 | House | 425/458 |
| 4,848,961 | 7/1989 | Rouillard | 425/458 |
| 5,056,245 | 10/1991 | Jenkins et al. | D8/10 |
| 5,406,671 | 4/1995 | Green | 15/245.1 |
| 5,459,928 | 10/1995 | Lynn et al. | 15/236.07 |

*Primary Examiner*—David Scherbel
*Assistant Examiner*—James F. Hook
*Attorney, Agent, or Firm*—John H. Crozier

[57] ABSTRACT

In a preferred embodiment, a tool for applying a viscous material to a curved surface, including: a thin, flexible, planar blade having first and second side edges; and first and second elongate handles depending from the blade, the first and second handles being attached to the blade near the first and second side edges, respectively, and configured to be manually grasped by a user of the tool.

8 Claims, 2 Drawing Sheets

METHOD AND APPARATUS FOR APPLYING VISCOUS MATERIALS TO CURVED SURFACES

BACKGROUND OF THE INVENTION

1. Field of the Invention.

The present invention relates to method and apparatus for applying viscous materials to curved surfaces generally and, more particularly, but not by way of limitation, to novel such method and apparatus which are particularly useful in the application of drywall paste and similar viscous materials to curved surfaces.

2. Background Art.

A need exists for method and apparatus for applying drywall paste and similar viscous materials to curved surfaces, which are quickly and easily employed.

A number of prior devices have been developed to address the problem of applying plaster, cement, and/or paste materials to curved surfaces. For example, U.S. Pat. Nos. 952, 971, issued Mar. 22, 1910, to Wolary et al.; 1,067,301, issued Jul. 15, 1913, to Bricker; 1,083,099, issued Dec. 30, 1913, to Howg; 1,743,704, issued Jan. 14, 1930, to Boux; and 2,947,017, issued Aug. 2, 1960, to Dybdahl, all describe trowel-type implements having blades which are selectively fixed to finish a concave or convex surface. While most of these devices are adjustable, once adjusted, the blades can be used for only one particular curve and the shapes of the blades cannot be changed without time consuming mechanical adjustments. The blades are unsuitable for compound curved surfaces where the surface may change from convex to concave or from convex to flat, for example. Also, the mechanically adjusted devices require more complicated clean up, maintenance, and lubrication.

In the automobile body repair field, small flexible tools have been developed for applying plastic filler materials, such as described in U.S. Pat. Nos. 3,341,878, issued Sep. 19, 1967, and 4,631,019, issued Dec. 23, 1986. Both of the devices described are intended for small intricate auto body work and have fingertip grips for grasping and bending the blades of the tools to conform to the surfaces being filled. Neither tool is designed to move and spread large amounts of viscous material such as drywall compound plaster.

Because of the lack of method and apparatus for applying viscous materials such as drywall paste to curved surfaces, the conventional method of doing so it to use a straight blade and in the case of a vertical column, for example, draw it horizontally around the column. This technique is somewhat limited and is difficult to apply when compound surfaces are involved.

A further disadvantage of conventional drywall finishing blades is that they have a single, centrally mounted handle for one-handed use. Such blades tend to leave ripples in the joint compound because the ends of the blades are free to twist back and forth. Also these blades are relatively small, about 10 to 14 inches wide, which means more passes, more work, and more touch-ups.

Accordingly, it is a principal object of the present invention to provide method and apparatus for applying viscous materials to curved surfaces that are quickly and easily employed.

It is a further object of the invention to provide such apparatus that can accommodate different curved surfaces without mechanical adjustment.

It is an additional object of the invention to provide such apparatus that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a tool for applying a viscous material to a curved surface, comprising: a thin, flexible, planar blade having first and second side edges; and first and second elongate handles depending from said blade, said first and second handles being attached to said blade near said first and second side edges, respectively, and configured to be manually grasped by a user of said tool.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 2:
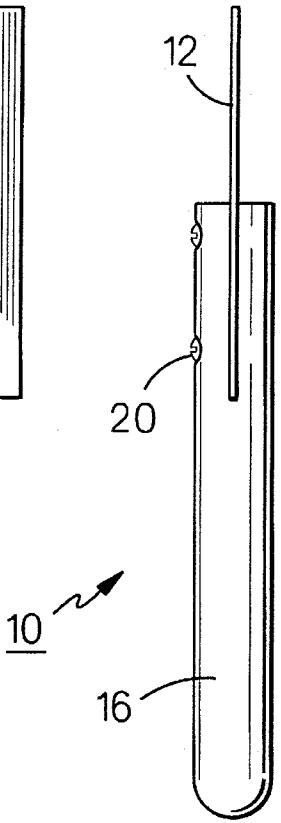
FIG. 2 is a side elevational view of the finishing tool.

Reference should now be made to the drawing figures, on which similar or identical elements are given consistent identifying numerals throughout the various figures thereof.

Figure 1:
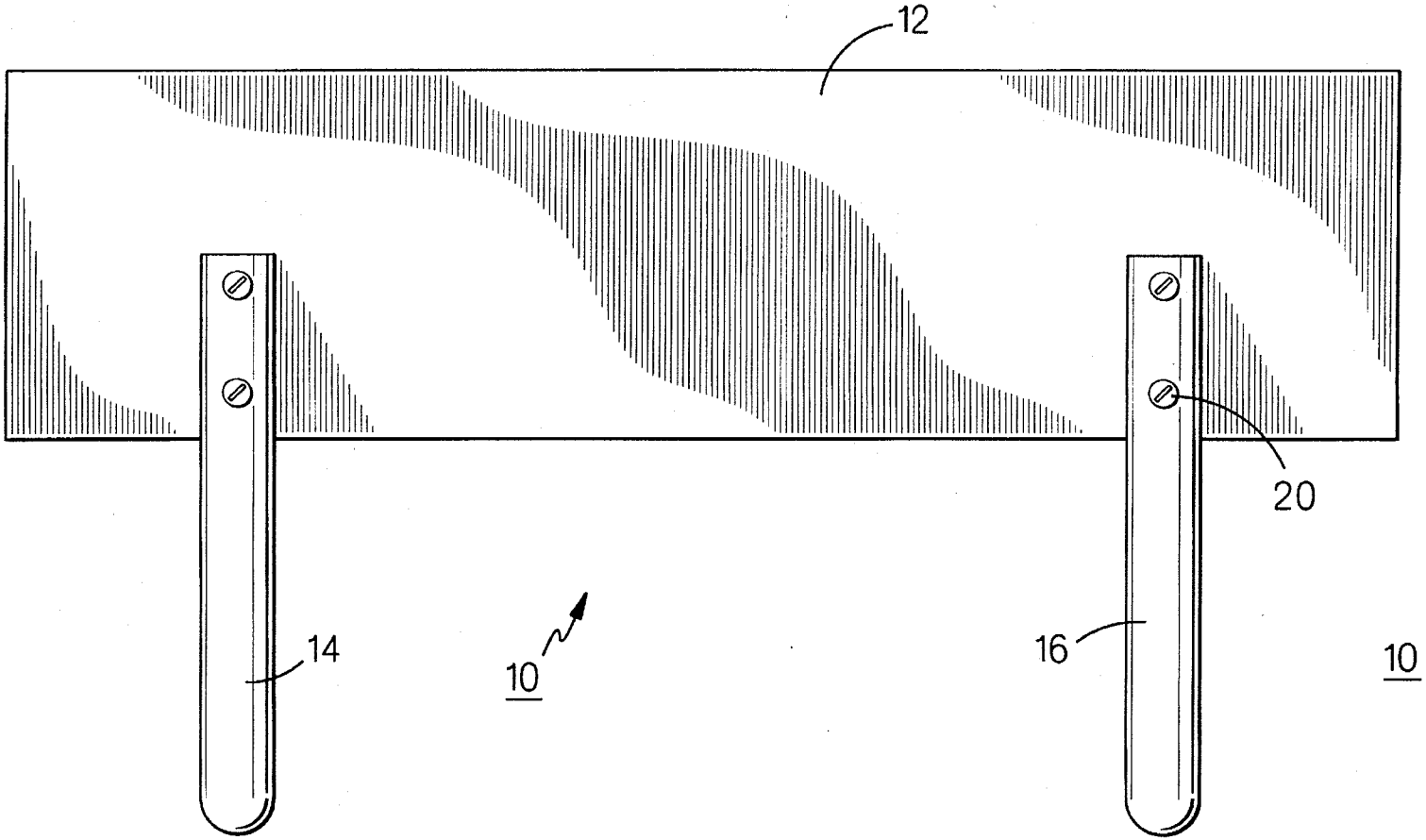
FIG. 1 is front elevational view of a finishing tool constructed according to the present invention.

FIGS. 1 and 2 illustrate a finishing tool constructed according to the present invention, generally indicated by the reference numeral 10. Tool 10 includes a flat, flexible, metal blade 12 which is preferably on the order of about six inches high by about 24 inches long.

Two elongate handles 14 and 16 depend substantially orthogonally from blade 12 and are attached thereto by a plurality of fasteners, as at 20. The central axes of handles 14 and 16 lie in the plane of blade 12.

Figure 3:
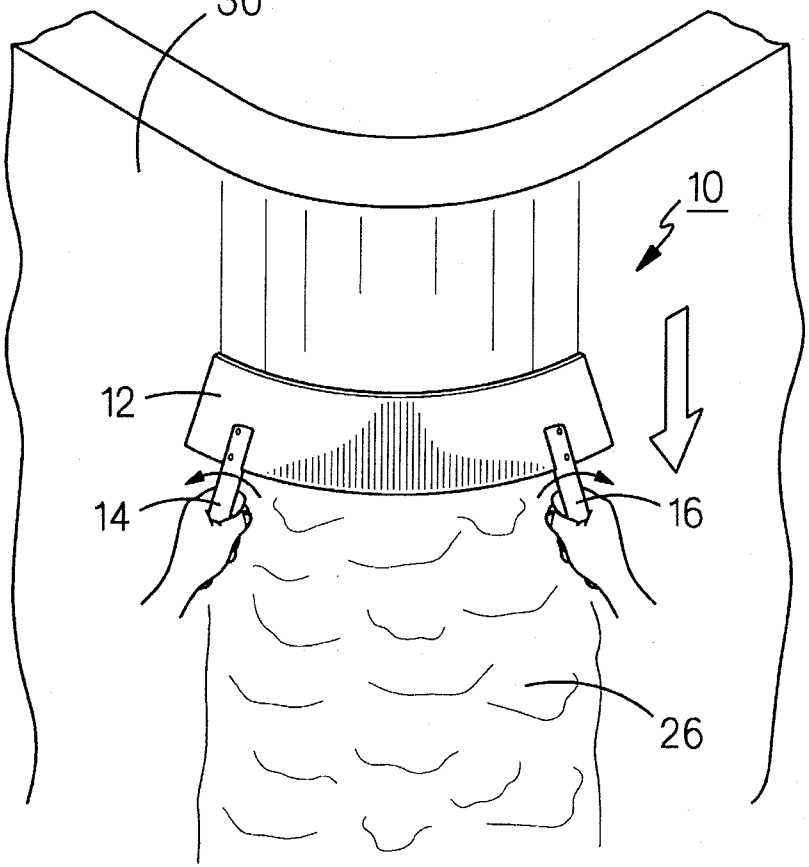
FIG. 3 is a perspective view of the finishing tool being employed to smooth a viscous material on a convex surface.

FIG. 3 illustrates finishing tool 10 being employed to smooth viscous material 26 on a convex surface 30. Blade 12 of tool 10 has been given the appropriate shape by the user grasping handles 14 and 16 and rotating the handles away from each other, as indicated by the small arrows around the handles, thus causing blade 12 to twist and assume the shape shown. Tool 10 is then drawn downwardly, as indicated by the large arrow, with the lower edge of blade 12 lifted somewhat from surface 30, to smooth material 26 which may be assumed to be drywall paste, plaster, or a similar viscous material.

Figure 4:
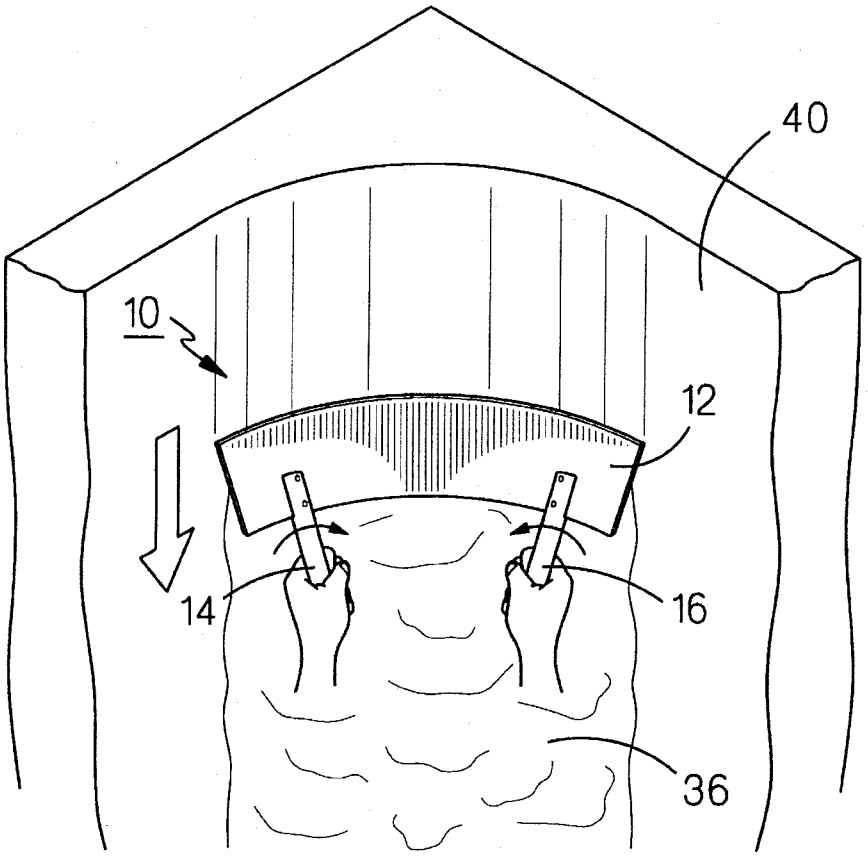
FIG. 4 is a perspective view of the finishing tool being employed to smooth a viscous material on a concave surface.

FIG. 4 illustrates finishing tool 10 being employed to smooth viscous material 36 on a concave surface 40. Here, blade 12 of tool 10 has been given the appropriate shape by the user grasping handles 14 and 16 and rotating the handles toward each other, as indicated by the small arrows around the handles, thus causing blade 12 to twist and to assume the shape shown. Tool 10 is then drawn downwardly, as indicated by the large arrow, with the lower edge of blade 12 lifted somewhat from surface 40, to smooth material 26 which, again, may be assumed to be drywall paste, plaster, or a similar viscous material.

It will be understood that finishing tool 10 can be employed, as well, to apply and smooth viscous materials on compound curved surfaces or on combination curved and flat surfaces by changing the degree and/or direction of twisting of handles 14 and 16 as blade 12 is drawn over a surface. Of course, finishing tool 10 can be used on flat surfaces by leaving handles 14 and 16 in "neutral" positions to maintain blade 12 in a flat configuration.

Having two handles 14 and 16 spaced near the side edges of blade 12 permits the use of a wider blade which, in turn, permits the user to cover more area with a single pass and results in less imperfections.

Tool 10 can be economically constructed of any suitable materials and is easily cleaned.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A tool for applying a viscous material to a curved surface, comprising:

(a) a tin, flexible, generally rectilinear, planar blade having a top edge and a bottom edge and first and second side edges; and (b) first and second elongated handles depending from said bottom edge of said blade, said first and second handles being attached to said blade near said first and second side edges, respectively, and configured to be manually grasped by a user of said tool to enable said user to bend said planar blade.

2. A tool, as defined in claim 1, wherein: said blade and said first and second handles are so arranged that manual grasping of said first and second handles and rotating said first and second handles away from each other will cause said blade to twist and assume a first curved configuration and rotating said first and second handles toward each other will cause said blade to twist and assume a second curved configuration.

3. A tool, as defined in claim 1, wherein: said first and second handles depended substantially orthogonally from said blade and the axes thereof lie in a plane defined by said blade.

4. A tool, as defined in claim 1, wherein said blade is on the order of about 24 inches wide.

5. A method of applying a viscous material to a curved surface, comprising:

(a) providing a thin, flexible, generally rectilinear, planar blade having a top edge and a bottom edge and first and second side edges; and (b) providing first and second elongate handles depending from said bottom edge of blade, said first and second handles being attached to said blade near said first and second side edges, respectively, and configured to be manually grasped by a user of said tool; and (c) said user grasping said first and second handles and rotating said first and second handles away from each other so as to cause said blade to twist and assume a first curved configuration.

6. A method, as defined in claim 5, further comprising the step of: said user rotating said first and second handles toward each other so as to cause said blade to twist and assume a second curved configuration.

7. A method, as defined in claim 5, further comprising: providing said first and second handles depending substantially orthogonally from said blade and providing the axes thereof lying in a plane defined by said blade.

8. A method, as defined in claim 5, further comprising: providing said blade on the order of about 24 inches wide.

* * * * *